US006131870A

United States Patent [19]

Tseng

[11] Patent Number: 6,131,870

[45] Date of Patent: Oct. 17, 2000

[54] HEIGHT ADJUSTING APPARATUS WITH INTERMESHING BEVEL GEARS

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/361,797

[22] Filed: Jul. 27, 1999

[51] Int. Cl.[7] ..... F16M 11/08; A47B 9/04; A47B 9/20

[52] U.S. Cl. ..... 248/406.1; 248/405; 108/147

[58] Field of Search ..... 248/406.1, 159, 248/410, 354.1, 125.2, 161, 158, 404, 405, 188.5; 108/147, 147.19, 144.11

[56] References Cited

U.S. PATENT DOCUMENTS

| | | | |
|---|---|---|---|
| 1,041,701 | 10/1912 | Thornley | 248/406.1 |
| 2,176,536 | 10/1939 | McCauley | 248/405 |
| 2,368,746 | 2/1945 | Doty | 108/147 |
| 2,475,411 | 7/1949 | Squires | 108/147 |
| 2,893,470 | 7/1959 | Peller | 248/405 |
| 3,086,743 | 4/1963 | Littman | 248/405 |
| 3,210,846 | 10/1965 | Balkin | 108/147 |
| 3,923,280 | 12/1975 | Good | 248/405 |
| 4,728,072 | 3/1988 | Mitchell | 248/406.1 |
| 4,750,701 | 6/1988 | Folson et al. | 248/406.1 |
| 4,967,619 | 11/1990 | Kato | 74/837 |
| 5,685,510 | 11/1997 | Frankish | 248/405 |

FOREIGN PATENT DOCUMENTS

| | | | |
|---|---|---|---|
| 1045510 | 10/1966 | United Kingdom | 248/405 |

*Primary Examiner*—Ramon O. Ramirez
*Assistant Examiner*—Jon A Szumny
*Attorney, Agent, or Firm*—Ladas & Parry

[57] ABSTRACT

A height adjusting apparatus includes a vertical outer tube that is adapted to be fixed on the base, and a vertical inner tube that is adapted to be fixed on the working table and that is mounted telescopically on the outer tube. A guiding device guides the inner tube to move vertically within the outer tube while preventing rotation of the inner tube relative to the outer tube. An externally threaded vertical rod is journalled in the outer tube, and engages threadably an internal thread portion of the inner tube. A driving mechanism includes a driven bevel gear that is mounted coaxially and fixedly on the vertical rod, and a driving bevel gear, which is mounted rotatably in the outer tube and which meshes with the driven bevel gear. The driving bevel gear rotates about a horizontal axis so as to rotate the vertical rod, thereby moving the inner tube vertically within the outer tube. An adjusting member is mounted rotatably on an outer surface of the outer tube, and is connected fixedly to the driving bevel gear for driving the driving bevel gear. Preferably, an annular water seal is interposed between the inner tube and the upper end portion of the outer tube to establish a water-tight seal therebetween.

4 Claims, 4 Drawing Sheets

HEIGHT ADJUSTING APPARATUS WITH INTERMESHING BEVEL GEARS

BACKGROUND OF THE INVENTION

1. Field of the Invention

This invention relates to a height adjusting apparatus, more particularly to a height adjusting apparatus, which has two intermeshing bevel gears that rotate a threaded vertical rod to move an inner tube vertically within an outer tube.

2. Description of the Related Art

Referring to FIG. 1, a conventional height adjusting apparatus 10 is shown to include a vertical outer tube 101 that is formed with a threaded hole 102, and a threaded vertical rod 103 engaging threadably within the threaded hole 102 in the outer tube 101. The vertical rod 103 has an upper end with a fixed horizontal connecting plate 104, which is adapted to be secured to a working table 11 (shown by the phantom lines) by bolts 105. The outer tube 101 has a lower end, which is fixed on a base 12 (shown by the phantom lines). Although the height of the working table 11 can be adjusted as desired, it is necessary to rotate the working table 11 relative to the base 12 during height adjustment. In some cases, however, it is unsuitable to do so. For example, some dishes or heavy objects may have been placed on the working table 11. Or, the working table 11 is a seat, on which a person is seated. Furthermore, because no water-proof structure is provided on the conventional apparatus 10, the apparatus 10 can only be used indoors.

SUMMARY OF THE INVENTION

An object of this invention is to provide a height adjusting apparatus, which can be operated easily.

Another object of this invention is to provide a height adjusting apparatus, which can be used outdoors with the assistance of a water seal.

According to this invention, a height adjusting apparatus includes a vertical outer tube that is adapted to be fixed on the base, and a vertical inner tube that is adapted to be fixed on the working table and that is mounted telescopically on the outer tube. A guiding device guides the inner tube to move vertically within the outer tube while preventing rotation of the inner tube relative to the outer tube. An externally threaded vertical rod is journalled in the outer tube, and engages threadably an internal thread portion of the inner tube. A driving mechanism includes a driven bevel gear that is mounted coaxially and fixedly on the vertical rod, and a driving bevel gear, which is mounted rotatably in the outer tube and which meshes with the driven bevel gear. The driving bevel gear rotates about a horizontal axis so as to rotate the vertical rod, thereby moving the inner tube vertically within the outer tube. An adjusting member is mounted rotatably on an outer surface of the outer tube, and is connected fixedly to the driving bevel gear for driving the driving bevel gear. Preferably, an annular water seal is interposed between the inner tube and the upper end portion of the outer tube to establish a water-tight seal therebetween.

BRIEF DESCRIPTION OF THE DRAWINGS

These and other features and advantages of the invention will become apparent in the following detailed description of a preferred embodiment of this invention, with reference to the accompanying drawings, in which.

DETAILED DESCRIPTION OF THE PREFERRED EMBODIMENT

Figure 1:
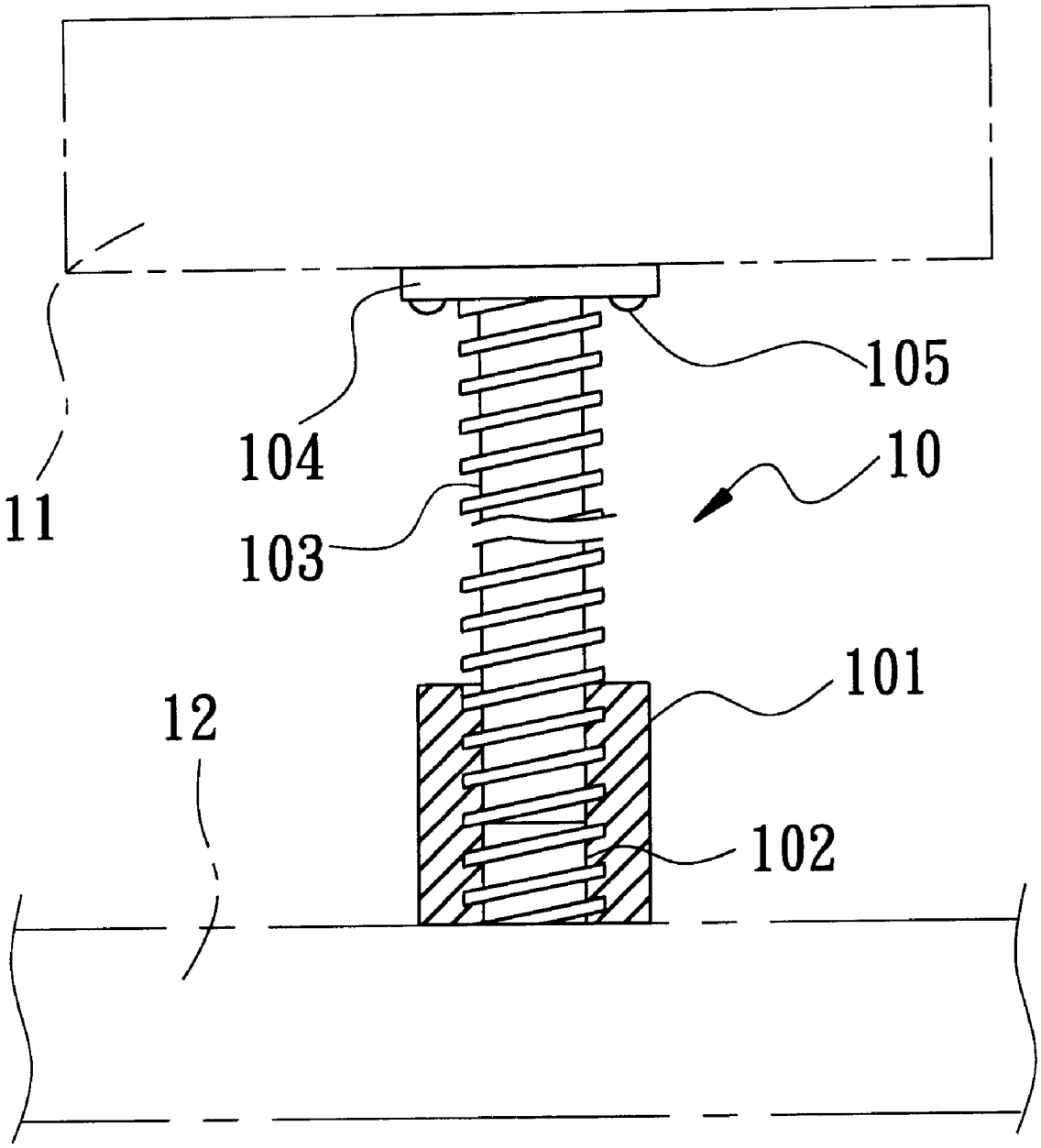
FIG. 1 PRIOR ART
FIG. 1 is a schematic side view of a conventional height adjusting apparatus.
Figure 2:
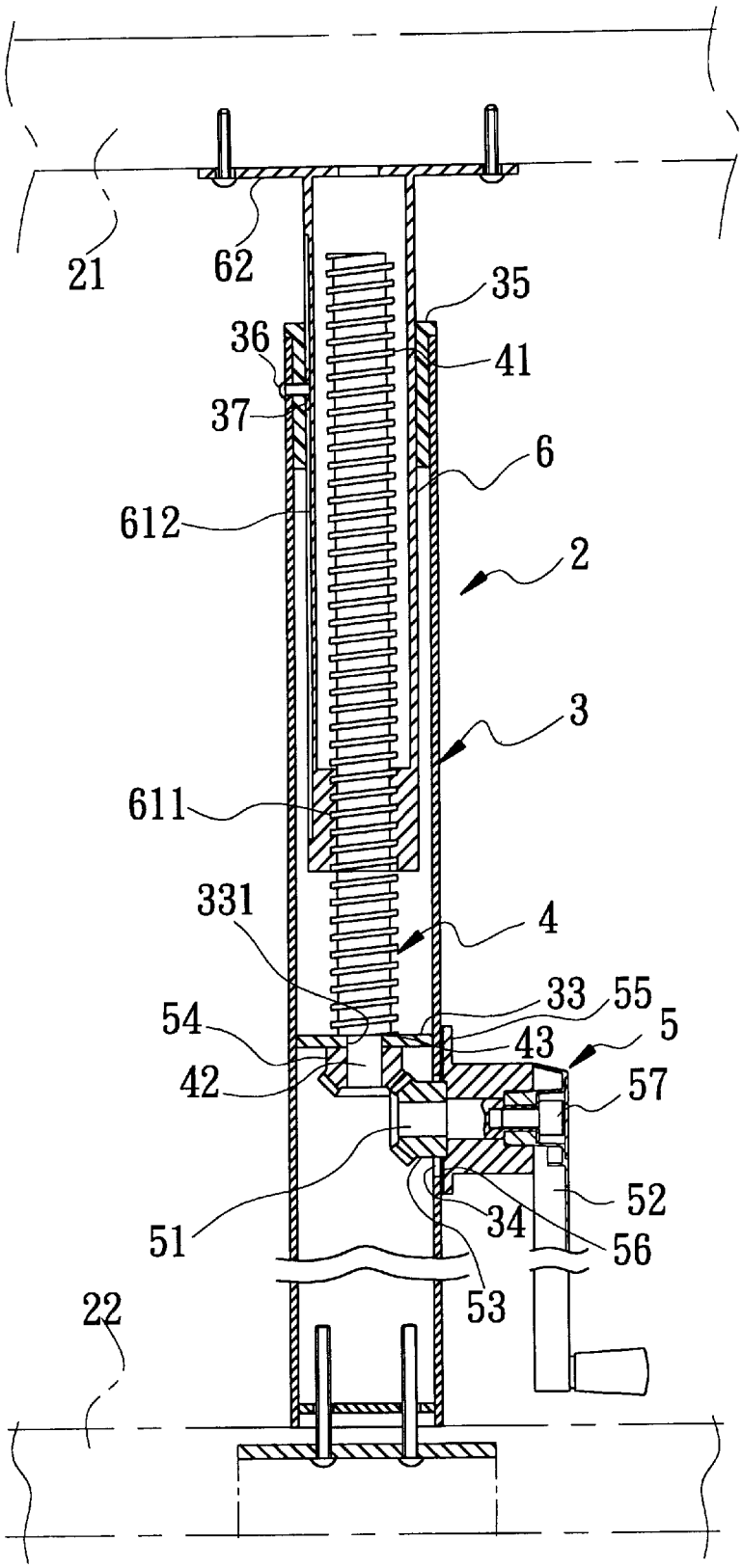
FIG. 2 is a schematic sectional view of the preferred embodiment of a height adjusting apparatus according to this invention.

Referring to FIG. 2, the preferred embodiment of a height adjusting apparatus according to this invention is shown to include a vertical outer tube 3, an externally threaded vertical rod 4, a driving mechanism 5, and a vertical inner tube 6. The apparatus mounts a working table 21 (shown by the phantom lines) on a base 22 (shown by the phantom lines). The working table 21 may be a seat or a tabletop.

Figure 3:
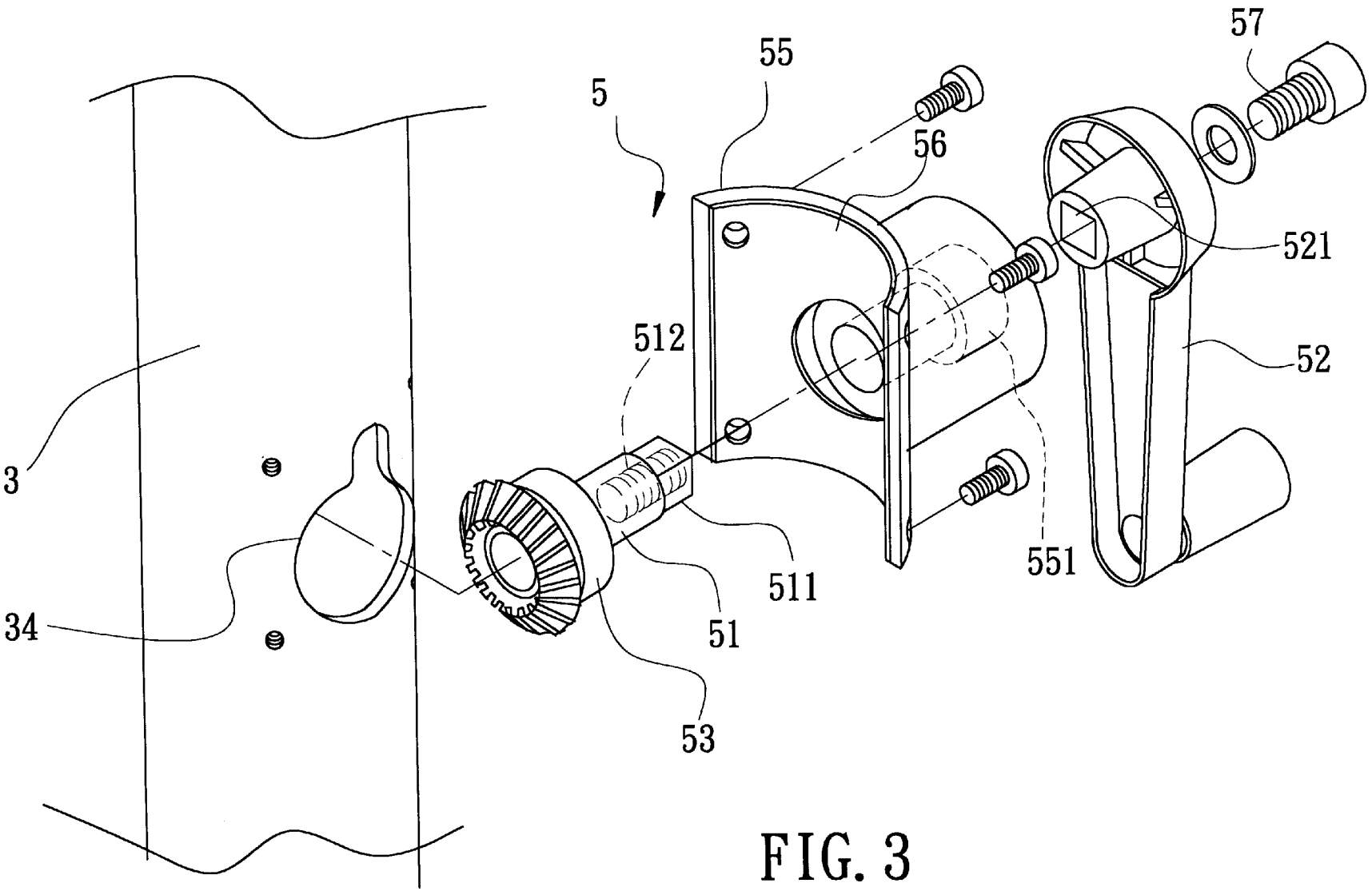
FIG. 3 is an exploded perspective view of a driving mechanism of the preferred embodiment, in which a driven bevel gear is removed for the sake of clarity.

The outer tube 3 has a lower end portion, which is adapted to be fixed on the base 22, and is provided with a small horizontal plate 33, which is welded to the outer tube 3 and which has a central hole 331 that is formed therethrough. A mounting hole 34 (see FIG. 3) is formed through a wall in the outer tube 3 for mounting the driving mechanism 5 on the outer tube 3.

The inner tube 6 is mounted telescopically on the outer tube 3, and has an upper end portion, which is formed integrally with a large horizontal plate 62 that is adapted to be bolted to the working table 21, and an internal thread portion 611.

To prevent entrance of rain water into the outer tube 3, an annular water seal 35 is interposed between the inner tube 6 and an upper end portion of the outer tube 3 to establish a water-tight seal therebetween.

Figure 4:
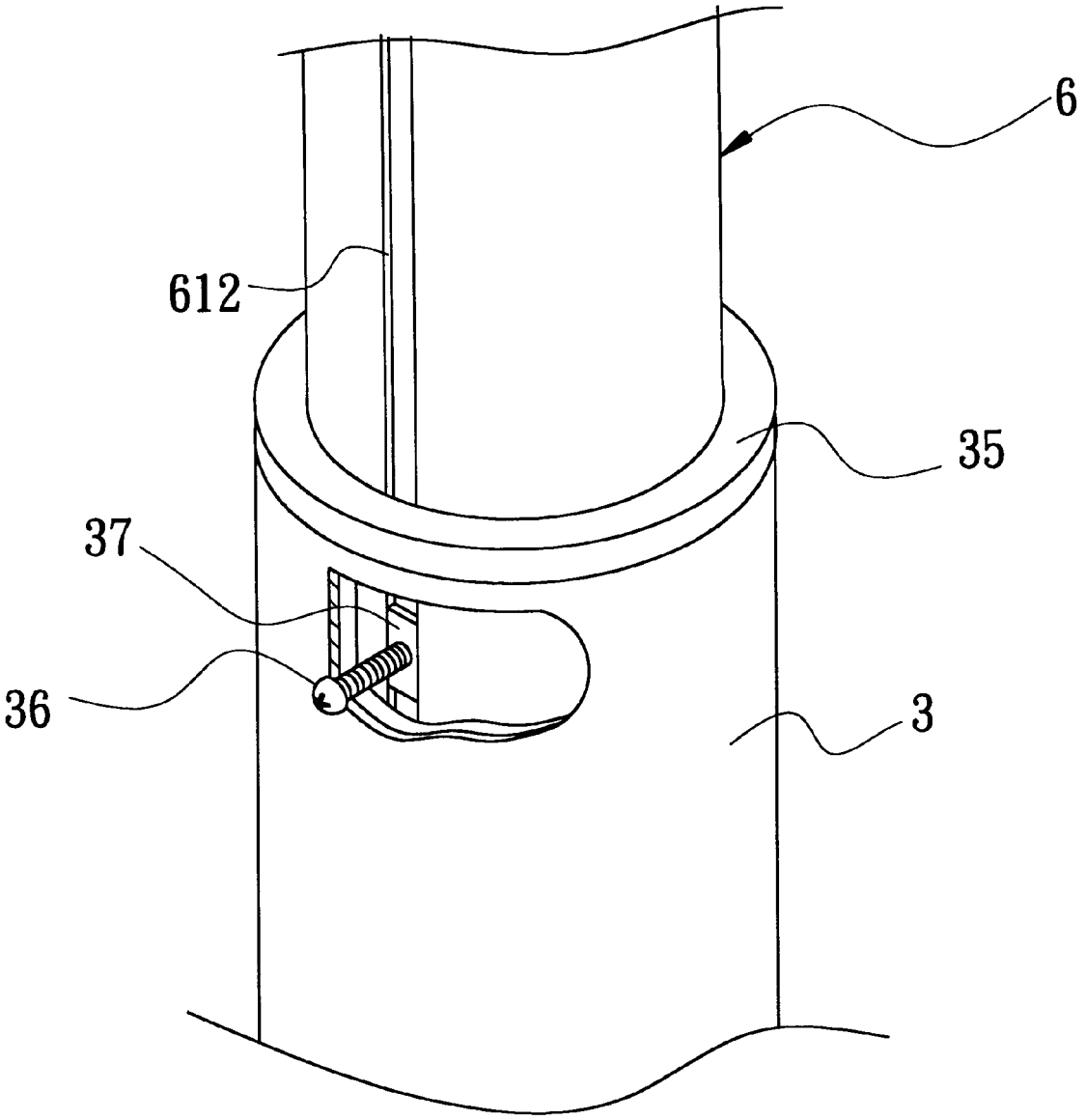
FIG. 4 is a partly sectional view of an upper portion of the preferred embodiment, illustrating a guiding device.

A guiding device includes a vertical slide slot 612 (see FIG. 4) formed in an outer surface of the inner tube 6, and a radial bolt 36, which is mounted fixedly on the outer tube 3, and which extends into the slide slot 612 in the inner tube 6. The radial bolt 36 is provided with a plastic sliding element 37 (see FIG. 4), which is sleeved fixedly thereon and which is received slidably within the slide slot 612 in the inner tube 6, thereby permitting smooth sliding movement of the bolt 36 within the slide slot 612. As such, the inner tube 6 is guided to move vertically within the outer tube 3, and is prevented from rotation relative to the same.

The vertical rod 4 has a threaded portion 41, and a diameter-reduced non-threaded lower end 42, which has a diameter smaller than that of the threaded portion 41 and which extends through the central hole 331 in the small horizontal plate 33. The threaded portion 41 engages threadably the internal threaded portion 611 of the inner tube 6. The non-threaded lower portion 42 and the threaded portion 41 define a shoulder 43 therebetween, which abuts against the small horizontal plate 33.

The driving mechanism 5 includes a connecting shaft 51, an adjusting member or rotary arm 52, a driving bevel gear 53, a driven bevel gear 54, a cover 55, a water-proof sheet 56, and a bolt 57.

The driven bevel gear 54 is sleeved fixedly on the non-threaded lower end 42 of the vertical rod 4, and is adjacent to the small horizontal plate 33. The connecting shaft 51 is formed integrally with the driving bevel gear 53, and is formed with a square-sectioned insert end portion 511 that engages fittingly a square hole 521 in the adjusting member 52 for rotating with the adjusting member 52. The bolt 57 extends through the square hole 521 in the adjusting member 52 and a counterbore 551 in the cover 55 to engage a threaded hole 512 in the connecting shaft 51, thereby connecting the adjusting member 52 fixedly to the driving bevel gear 53. The cover 55 is bolted to the outer tube 3. The connecting shaft 51 is journalled within the counterbore 551 in the cover 55. The driving bevel gear 53 meshes with the driving bevel gear 54. The water-proof sheet 56 is clamped between the cover 55 and the outer tube 3.

When the adjusting member 52 is actuated, the driving bevel gear 53 rotates about a horizontal axis so as to rotate the vertical rod 4, thereby moving the inner tube 6 within the outer tube 3. As such, the working table 21 does not rotate relative to the base 22 during height adjustment. Accordingly, the apparatus of this invention can be operated easily by rotating the adjusting member 52. Furthermore, because the water seal 35 and the water-proof sheet 56 are provided on the outer tube 3, the apparatus of this invention can be used outdoors even when it is raining.

With this invention thus explained, it is apparent that numerous modifications and variations can be made without departing from the spirit and scope of this invention. It is therefore intended that this invention be limited only as indicated by the appended claims.

I claim:

1. A height adjusting apparatus adapted to mount a working table on a base and comprising:

a vertical outer tube having a lower end portion, which is adapted to be fixed on a base;

a vertical inner tube having an upper end portion that is adapted to be fixed on a working table, and mounted telescopically on said outer tube, said inner tube further including an internal thread portion;

a guiding device for guiding said inner tube to move vertically within said outer tube while preventing rotation of said inner tube relative to said outer tube;

said guiding device including a vertical slide slot formed in an outer surface of said inner tube; and a radial bolt mounted fixedly on said outer tube and extending slidably into said slide slot in said inner tube;

an externally threaded vertical rod journalled in said outer tube and engaging threadably said internal thread portion of said inner tube;

a driving mechanism including a driven bevel gear that is mounted coaxially and fixedly on said vertical rod, and a driving bevel gear, which is mounted rotatably in said outer tube and which meshes with said driven bevel gear, said driving bevel gear rotating about a horizontal axis so as to rotate said vertical rod, thereby moving said inner tube vertically within said outer tube; and an adjusting member mounted rotatably on an outer surface of said outer tube and connected fixedly to said driving bevel gear for driving said driving bevel gear.

2. The height adjusting apparatus as claimed in claim 1, further comprising an annular water seal, which is interposed between said inner tube and an upper end portion of said outer tube to establish a water-tight seal therebetween.

3. The height adjusting apparatus as claimed in claim 1, wherein said radial bolt is provided with a plastic sliding element, which is sleeved fixedly thereon and which is received slidably within said slide slot in said inner tube.

4. The height adjusting apparatus as claimed in claim 1, wherein said outer tube is provided with a small horizontal plate, which is fixed therein and which has a central hole that is formed therethrough, said vertical rod having a threaded portion, and a diameter-reduced non-threaded lower end portion, which has a diameter smaller than that of said threaded portion and which extends through said central hole in said small horizontal plate, said driven bevel gear being sleeved fixedly on said non-threaded lower end portion of said vertical rod and being disposed adjacent to said small horizontal plate, said threaded portion and said non-threaded lower end portion defining a shoulder therebetween, which abuts against said small horizontal plate.

* * * * *